US005516236A

United States Patent [19]

Williams et al.

[11] Patent Number: 5,516,236

[45] Date of Patent: May 14, 1996

[54] TIMBER PILE PROTECTION SYSTEM

[75] Inventors: Lucian T. Williams; Michael D. Summers, both of Houston, Tex.

[73] Assignee: Winn & Coales (Denso), Ltd., London, England

[21] Appl. No.: 262,402

[22] Filed: Jun. 20, 1994

[51] Int. Cl.[6] ..... E02D 5/60

[52] U.S. Cl. ..... 405/216; 52/170; 405/211

[58] Field of Search ..... 405/216, 211; 52/512, 514, 515, 169.14, 170

[56] References Cited

U.S. PATENT DOCUMENTS

| | | | |
|---|---|---|---|
| 2,724,156 | 11/1955 | Shaw | 52/170 |
| 2,874,548 | 2/1959 | Drushel et al. | 405/216 |
| 3,103,103 | 9/1963 | Liddell | 405/216 |
| 3,139,731 | 7/1964 | Liddell . | |
| 3,177,667 | 4/1965 | Liddell . | |
| 3,321,924 | 5/1967 | Liddell | 405/216 |
| 3,362,124 | 1/1968 | Cravens et al. | 52/514 |
| 3,996,757 | 12/1976 | Liddell | 405/216 |
| 3,999,399 | 12/1976 | Maurer | 405/216 X |
| 4,023,374 | 5/1977 | Colbert et al. . | |
| 4,068,483 | 1/1978 | Papworth . | |
| 4,252,471 | 2/1981 | Straub | 405/211 |
| 4,697,957 | 10/1987 | Hellmers | 405/216 |
| 4,713,129 | 12/1987 | Inhofe, Jr. et al. | 156/71 |
| 4,921,555 | 5/1990 | Skiff | 52/170 X |
| 5,102,265 | 4/1992 | Dokmo et al. | 405/216 |
| 5,138,806 | 8/1992 | Marx et al. | 52/170 |

*Primary Examiner*—Dennis L. Taylor
*Attorney, Agent, or Firm*—Fulbright & Jaworski

[57] ABSTRACT

A device for protectively encasing wooden piles to reduce marine borer attack, abrasion and other structural damage, comprising: a sheet of flexible plastic wrapped around a pile in a substantially circumferential configuration, where the longitudinal edges of the sheet are placed in an overlapping position; compressible seals attached to both of the horizontal edges of the sheet and to one of the longitudinal edges of the sheet; strap members encompassing the compressible seals of the horizontal edges; a reinforcement member positioned adjacent to the outside longitudinal edge of the sheet; and a plurality of fastening means securing the reinforcement member and the overlapping longitudinal edges to the piling. The present invention also provides a method for protectively encasing a wooden pile against marine borer attack, comprising the steps of cleaning and preparing the surface of the piling by removing all marine growth and foreign matter, wrapping the flexible plastic sheet around the piling, overlapping the longitudinal edges of the sheet, placing a strap around the bottom and top of the sheet to ensure a uniform overlap at the top and bottom of the sheet, tightening the straps so as to ensure a sealing engagement of the sheet and the piling, placing a reinforcement strip upon the overlapping longitudinal edges, and driving nails or comparable fasteners through the reinforcement strip, overlapping longitudinal edges and into the piling.

13 Claims, 1 Drawing Sheet

TIMBER PILE PROTECTION SYSTEM

FIELD OF THE INVENTION

This invention relates generally to an apparatus for protectively encasing the wooden pilings of piers, wharfs or other structures to reduce marine borer attack.

BACKGROUND

The present invention relates to an apparatus used for protectively encasing wooden piles to reduce marine borer attack, abrasion and other structural damage. Piers, wharfs, and other structures extending from a shore or free-standing in a body of water are commonly supported by wooden piles. Immersion of wooden pile in seawater and a marine environment exposes the pile to marine borer infestation and abrasion damage. The present invention provides an encasement around a pile to create an environment of stagnant water between the pile and the encasement that is toxic to borers. Marine borers can destroy a creosote treated pile in less than 6 years. In heavily-infested waters, the timber will receive attack from the mud-line to high tide levels.

Various devices and methods have been used in the past to protect piles. One of the oldest methods of protecting piles is to soak wooden piles in creosote or tar. However, the tar soon wears off. Further, the use of creosote in this way raises environmental concerns.

More recently, devices and methods using sheeting of various materials has been employed. It is important to choose an appropriate material for the protective sheeting. For example, some protective coverings employ polyvinyl chloride plastic sheeting. Such PVC sheeting is not stable in the presence of creosote and deteriorates and becomes brittle over time. Fiberglass-reinforced plastic, on the other hand, is generally pre-formed and will not conform to surface imperfections and variations in the shape and diameter of pilings.

Piling encasement devices known in the art are secured by belts, rings, tongue and groove means, heat seals, hook and eye means, and bolts have been used. Such methods of securing a sheet to a pile have proved unsatisfactory. Most pile coverings secured in these ways do not produce a proper seal and permit too much circulation of seawater next to the piling allowing marine borers to survive and multiply. Further, most of the above sealing means are not stable in the presence of creosote, or do not stand up to the variations in seawater temperature or to turbulent wave action. The mere use of sheeting and nails is not sufficient because wave action can tear the sheeting away from the piling. Heat sealing, used most often with steel pilings but also used with wood, presents problems in water with varying temperature: where the water is cold near the bottom of the piling, the seal does not form; and where the water is warm near the surface, the heat is too intense and the sealing or sheeting material can be destroyed. Additionally, heat sealing utilizes both heat and pressure to form the seal. Due to surface imperfections and variations in the shape of wood piles, uniform pressure is difficult to achieve.

Further, some methods of sealing do not allow for a large variety of sheet thicknesses to be used. For example, some methods known in the art require the use of sheeting with a thickness of 60 mils or less.

Other means and methods for securing and sealing a sheet to a pile are difficult or expensive to perform. Divers and other laborers are expensive to employ and the water environment makes many tasks, which would be otherwise be simple and inexpensive to perform, very difficult and time consuming.

Examples of such prior piling protectors are disclosed in the following U.S. patents: Liddell, U.S. Pat. No. 3,139,731; Liddell, U.S. Pat. No. 3,177,667; Cravens et al., U.S. Pat. No. 3,362,124; Colbert et al., U.S. Pat. No. 4,023,374; Papworth, U.S. Pat. No. 4,068,483; Straub, U.S. Pat. No. 4,252,471; Hellmers, U.S. Pat. No. 4,697,957; Inhofe et al., U.S. Pat. No. 4,713,129; Dokmo et al., U.S. Pat. No. 5,102,265; and Marx et al., U.S. Pat. No. 5,138,806.

SUMMARY OF THE INVENTION

It is an object of the present invention is to provide an apparatus for protectively encasing a wooden pile against marine borer attack.

An additional object of the present invention is to provide an apparatus for the protection of a wooden pile that provides an improved method of sealing a pile with a plastic cover.

A further object of the present invention is to provide an apparatus for the protection of a wooden pile that can be installed within a limited working space, without the use of specialized equipment and without the removal of pier decking.

It is a particular object of the present invention to provide an encasement of the aforedescribed nature capable of installation on all lengths, shapes and diameters of piles, and on piles which no longer have a uniform taper or diameter.

An additional object of the present invention is to provide sealing means which allow for use of plastic sheets of various mil thicknesses.

It is an important object of the present invention to provide a barrier encasement which may be shop-fabricated for subsequent installation upon a pile. This arrangement permits the barrier encasement to be manufactured and installed at a minimum cost.

It is still a further object of the present invention to provide an apparatus for protectively encasing a wooden pile against marine borer attack that will withstand water turbulence and wave action.

A further object of the present invention is to provide a method for protectively encasing wood pilings.

Thus, in accomplishing the foregoing objects, there is provided in accordance with the present invention, an apparatus for protectively encasing a wooden pile against marine borer attack, comprising a sheet of flexible plastic wrapped around a pile in a substantially circumferential configuration, wherein the sheet has first and second longitudinal edges placed in an overlapping position, two horizontal edges, one of said horizontal edges proximal to the bottom of said piling and the other of said horizontal edges distal to the bottom of said piling; compressible seals attached to both of the horizontal edges of the sheet and to one of the longitudinal edges of the sheet; strap members encompassing the compressible seals of the horizontal edges; a reinforcement member positioned adjacent to the outside longitudinal edge of the sheet; and a plurality of fastening means securing the reinforcement member and the overlapping longitudinal edges to the piling.

Thus, in accomplishing the foregoing objects, there is provided in accordance with the present invention, a method for protectively encasing a wooden pile against marine borer attack, comprising: cleaning and preparing the surface of the piling by removing all marine growth and foreign matter, wrapping the flexible plastic sheet around the piling, overlapping the longitudinal edges of the sheet, placing a strap around the bottom and top of the sheet to ensure a uniform overlap at the top and bottom of the sheet, tightening the straps so as to ensure a sealing engagement of the sheet and the piling, placing a reinforcement strip upon the overlapping longitudinal edges, and driving nails or comparable fasteners through the reinforcement strip, overlapping longitudinal edges and into the piling.

Other and further objects, features and advantages will be apparent and the invention more readily understood from a reading of the following specification and by reference to the accompanying drawings forming a part thereof, wherein the examples of the presently preferred embodiments of the invention are given for the purposes of disclosure.

The drawings and figures are not to scale and certain features mentioned may be exaggerated in scale or shown in schematic form in the interest of clarity and conciseness.

DETAILED DESCRIPTION OF THE INVENTION

It will be apparent to one skilled in the art that various substitutions and modifications may be made to the invention disclosed herein without departing from the scope and the spirit of the invention.

Figure 1:
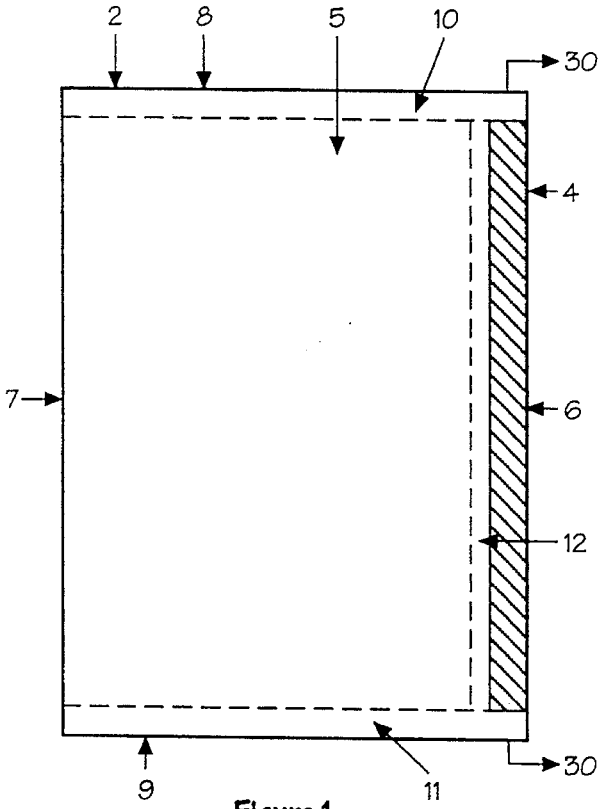
FIG. 1 is an elevational view of the barrier encasement embodying the present invention.

Referring now to FIGS. 1–4, there is shown a pile protection apparatus 1 which is suitably mounted to a pile 3. FIG. 1 shows the surface view of flexible sheet 2 adapted to be wrapped around a pile 3 in a substantially circumferential configuration. Sheet 2 can be comprised of any suitable plastic material. As seen most clearly in FIG. 1, sheet 2 has an inside 4 and an outside 5, said inside 4 of said sheet 2 is adapted to enclose the pile 3 and said outside 5 of said sheet 2 is adapted to face outward from said pile 3. Sheet 2 also has first and second longitudinal edges, 6 and 7, respectively, and first and second horizontal edges, 8 and 9 respectively. Longitudinal edges 6 and 7 of sheet 2 extend generally longitudinally of pile 3 and overlap when sheet 2 is wrapped around pile 3. Horizontal edge 8 of sheet 2 is distal to the bottom of pile 3 and horizontal edge 9 of sheet 2 is proximal to the bottom of pile 3.

Figure 2:
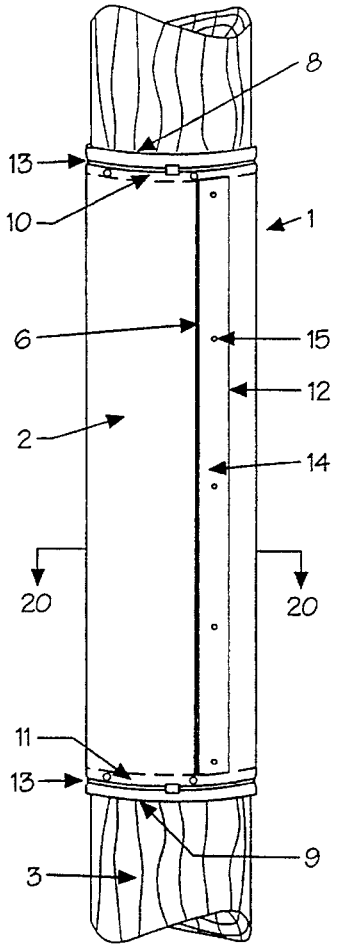
FIG. 2 is an elevational view of the protective sheet in place on a piling and indicating placement of the seals in accordance with the present invention.
Figure 3:
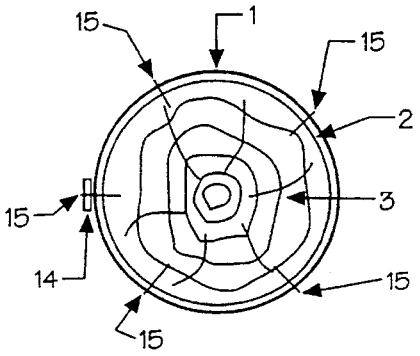
FIG. 3 is a cross sectional view taken along line 20—20 of FIG. 2.
Figure 4:
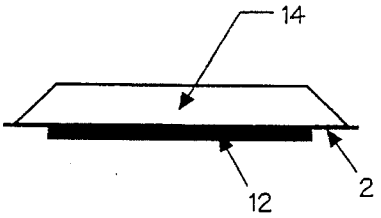
FIG. 4 is a crossectional view of the sheet taken along line 30—30 of FIG. 1.

Compressible seals 10 and 11 are attached to the inside 4 of sheet 2 along horizontal edges 8 and 9. Compressible seal 12 is attached to the inside 4 of sheet 2 along longitudinal edge 6. As illustrated in FIG. 2, strap members 13 are located on the outside 5 of sheet 2 and are adapted to encompass the compressible seals 10 and 11 of horizontal edges 8 and 9. FIGS. 2 and 3 illustrate reinforcement member 14 positioned adjacent to the outside 5 of sheet 2 along longitudinal edge 6, which overlaps longitudinal edge 7. Finally, fastening means 15 secure reinforcement member 14 and overlapped longitudinal edges 6 and 7 when sheet 2 is wrapped around pile 3. Additionally, as shown in FIG. 3, fastening means 15 may be used to further secure horizontal edges 8 and 9.

In one embodiment of the present invention, flexible sheet 2 is comprised of polyethylene. In a preferred embodiment, flexible sheet 2 is UV stabilized, and further comprised of 97.5% polymer and 2.5% carbon black, anti-oxidants and heat stabilizers. In a more preferred embodiment, flexible sheet 2 is uniform throughout, free from foreign matter and defects, and conforms to the following mechanical and physical requirements:

| | Physical Properties: | |
|---|---|---|
| Property | Test Method | Nominal Values |
| Thickness, mils | ASTM D751/ 1593/374 | 30–140 |
| Density (g/cc) | ASTM D792/1505 | 0.929 |
| Melt Flow Index (g/10 min.) | ASTM D1238-E | <1.0 |
| Tensile Strength | ASTM D882 Method A | |
| Machine Direction | | 2500 psi, minimum |
| Transverse Direction | | 2000 psi, minimum |
| Elongation | | 300% both directions |
| Volatility | ASTM D 1203 | .3 max. wgt. loss |
| Graves tear | ASTM D 1004 | 400 lb/in. |
| Shrinkage | ASTM D 1204 | 2% max. (30 mins. at 212° F.) |
| Carbon Black Content (percent) | ASTM D 1603 | 2.5 |

In another embodiment, straps 13 are made of a UV stabilized plastic. In a preferred embodiment, straps 13 have a minimum of 250 lbs breaking strength. In a most preferred embodiment, straps 13 are comprised of Delrin™ and are used in conjunction with Delrin™ buckles.

In another embodiment, fastener means 15 are nails comprised of stainless steel. In a preferred embodiment, fastener means 15, used to secure reinforcement member 14 along overlapping longitudinal edges 6 and 7, are stainless roofing nails with a minimum ring shank diameter of 0.150-inch, 1½-inch length and a minimum head diameter of ⅜-inches. Additional fastener means may also be used to further sealingly engage compressible seals 10 and 11 with pile 3. In a preferred embodiment, these fastener means are stainless steel nails having a minimum ring shank diameter of 0.131-inch, 3½-inch length, and a minimum head diameter of 11/32-inches. In a most preferred embodiment, a 3/32-inch fiat neoprene washer is used as well.

In yet another embodiment, reinforcement strip 14 is comprised of polyethylene. In a preferred embodiment, reinforcement strip 14 is comprised of medium density polyethylene designed specifically for injection molding. In a more preferred embodiment, reinforcement strip 14 is formed with a trapezoidal profile ⅜-inch thick with a 3-inch wide base. In a most preferred embodiment, reinforcement strip 14 conforms to the following properties:

| Property | ASTM Test Method | Typical Values |
|---|---|---|
| Density | D 1505 | 0.938 g/cc |
| Melt Index | D 1238 | 0.55 g/10 min |
| Tensile Strength | | |
| At Yield (2 in/min) | D 638 | 2800 psi |
| At Break (2 in/min) | D 638 | 3200 psi |
| Elongation At Break (2 in/min) | D 638 | >700% |

-continued

| Property | ASTM Test Method | Typical Values |
|---|---|---|
| Flexural Modlus | D 790 | 105,000 psi |
| Notched Izod Impact Strength | D 256 | 10.0 ft-lbf/in |
| Hardness (Shore D) | D 2240 | 63 |
| Vicat Softening Point | D 1525 | 257° F. |
| Brittleness Temperature | D 746 | <–103° F. |
| Environmental Stress Crack Resistance | D 1693 | >2000 hrs. |
| Hydrostiatic Design Basis | D 2837 | 1250 psi |
| Cell Classification | D 3350 | 22433C |

In an additional embodiment, seals 10, 11 and 12 are comprised of neoprene. In a preferred embodiment, seals 10, 11 and 12 have a thickness of 0.20 to 0.40 inches and are between 2 and 5 inches wide. In a most preferred embodiment, seals 10, 11 and 12 are comprised of neoprene having the following physical properties:

| Composition | Nitrile/PVC |
|---|---|
| Compression Deflection (PSI) | 5–9% |
| Density Lbs/ft$^2$ | 7–12 |
| Water Absorption by Weight | 5% max. |
| Compression Set ASTM D 1056-85 | 25% max. |
| Shrinkage | 4% max. |
| Tensile ASTM D 412-68 | 70 min. PSI |
| Elongation | 100% |

One skilled in the art will readily appreciate that the present invention is well adapted to carry out the objects and obtain the ends and advantages mentioned, as well as those inherent therein. The particular composition of the sheet, reinforcement strip, straps, nails and seals described herein are presently representative of preferred embodiments, are intended to be exemplary and are not intended as limitations on the scope of the invention. Changes therein and other uses which are encompassed within the spirit of the invention and are defined by the appended claims will occur to those skilled in the art.

What is claimed is:

1. An apparatus for protectively encasing a marine wooden pile against marine borer attack, comprising:

a sheet of plastic adapted to be wrapped around said pile in a substantially circumferential configuration, said sheet having an inside and an outside, said inside of said sheet adapted to enclose said piling and said outside of said sheet adapted to face away from said piling, first and second longitudinal edges adapted to overlap the pile forming an inside longitudinal edge and an outside longitudinal edge, said longitudinal edges extending generally longitudinally of said pile, and two horizontal edges, one of said horizontal edges proximal to the bottom of said piling and the other of said horizontal edges distal to the bottom of said piling, and wherein said plastic of said sheet consists of 90–98% polymer and 2–10% carbon black; compressible seals attached to both of said horizontal edges and to one of said longitudinal edges of said sheet on said inside of said sheet; strap members on the outside of said sheet adapted to encompass said compressible seals of said horizontal edges of said sheet; a reinforcement strip positioned on the outside of the outside longitudinal edge, said reinforcement strip securing said longitudinal edge from water turbulence and wave action; and nails for securing said reinforcement member and said overlapping longitudinal edges to said piling.

2. The apparatus of claim 1, wherein said polymer is comprised of polyethylene.

3. The apparatus of claim 2, wherein said polymer is high-density polyethylene.

4. The apparatus of claim 2, wherein said polymer is low-density polyethylene.

5. The apparatus of claim 1, wherein said polymer is polypropylene.

6. The apparatus of claim 1, wherein said compressible seals are made of neoprene.

7. The apparatus of claim 6, wherein said compressible seals have a thickness of 0.20 to 0.40 inches and are between 2 and 5 inches wide.

8. The apparatus of claim 1, wherein said strap members are comprised of UV stabilized plastic.

9. The apparatus of claim 1, wherein said nails are stainless steel nails.

10. The apparatus of claim 9, wherein said nails are driven through said reinforcement member at a spacing of every 9 inches.

11. The apparatus of claim 1, wherein the extent of said overlap of said first and second longitudinal edges is at least 3 inches.

12. The apparatus of claim 1, further comprising said nails driven through said sheet at pre-selected positions around said horizontal seals.

13. The apparatus of claim 1, wherein the reinforcement strip is comprised of medium density polyethylene designed specifically for injection molding.

* * * * *